US011105153B2

(12) United States Patent
Haberer et al.

(10) Patent No.: US 11,105,153 B2
(45) Date of Patent: Aug. 31, 2021

(54) EXTENDABLE APPARATUS, DRILL HEAD AND METHOD

(71) Applicant: SANDVIK INTELLECTUAL PROPERTY AB, Sandviken (SE)

(72) Inventors: Christoph Haberer, Hetzendorf (AT); Andreas Bischof, Obdach (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 311 days.

(21) Appl. No.: 15/768,068

(22) PCT Filed: Oct. 14, 2015

(86) PCT No.: PCT/EP2015/073813
§ 371 (c)(1),
(2) Date: Apr. 13, 2018

(87) PCT Pub. No.: WO2017/063692
PCT Pub. Date: Apr. 20, 2017

(65) Prior Publication Data

US 2018/0313153 A1 Nov. 1, 2018

(51) Int. Cl.

| | |
|---|---|
| ***E21B 3/02*** | (2006.01) |
| ***E21B 17/03*** | (2006.01) |
| ***E21B 7/02*** | (2006.01) |
| ***F15B 15/16*** | (2006.01) |
| ***E21D 20/00*** | (2006.01) |
| ***E21B 17/07*** | (2006.01) |

(52) U.S. Cl.
CPC ..... *E21B 3/02* (2013.01); *E21B 7/027* (2013.01); *E21B 17/03* (2013.01); *E21B 17/07* (2013.01); *E21D 20/00* (2013.01); *E21D 20/003* (2013.01); *F15B 15/16* (2013.01)

(58) Field of Classification Search
CPC ..... E21B 3/02; E21B 7/027; F15B 15/16
See application file for complete search history.

(56) References Cited

U.S. PATENT DOCUMENTS

| | | | | |
|---|---|---|---|---|
| 2,102,236 | A * | 12/1937 | Johansen | E21B 3/02 175/321 |
| 3,603,207 | A | 9/1971 | Parrett | |
| 2007/0086862 | A1 | 4/2007 | Koehler | |

(Continued)

FOREIGN PATENT DOCUMENTS

| | | | |
|---|---|---|---|
| JP | H03125788 | A | 5/1991 |
| RU | 2416509 | C2 | 4/2011 |
| WO | 2005047649 | A1 | 5/2005 |

*Primary Examiner* — Blake E Michener
(74) *Attorney, Agent, or Firm* — Corinne R. Gorski

(57) ABSTRACT

The present disclosure relates to an extendable apparatus, such as an extendable apparatus for a drill head, a drill head including an extendable apparatus, and a method of operating a drill head. The extendable apparatus includes a base section, a drive section, an extension section, and a functional section. The base section and the drive section are moveable with respect to the extension section and the functional section along a longitudinal axis. The drive section and the functional section are rotationally rigidly coupled to each other. The base section and the extension section are rotationally rigid coupled to each other, and the drive section and the functional section are rotationally moveably coupled to the extension section.

19 Claims, 10 Drawing Sheets

(56) References Cited

U.S. PATENT DOCUMENTS

| | | | | |
|---|---|---|---|---|
| 2007/0114070 | A1 | 5/2007 | Guede | |
| 2009/0304455 | A1 | 12/2009 | Bayerl et al. | |
| 2013/0068490 | A1* | 3/2013 | Van Zee | E21B 7/04 173/1 |
| 2014/0112724 | A1 | 4/2014 | Nelson | |
| 2014/0284107 | A1* | 9/2014 | Klein | E21B 7/023 175/55 |
| 2017/0342816 | A1* | 11/2017 | LaValley | E21B 47/00 |

* cited by examiner

EXTENDABLE APPARATUS, DRILL HEAD AND METHOD

RELATED APPLICATION DATA

This application is a § 371 National Stage Application of PCT International Application No. PCT/EP2015/073813 filed Oct. 14, 2015.

FIELD OF INVENTION

The invention relates to an extendable apparatus, in particular an extendable apparatus for a drill head. The invention further relates to a drill head comprising an extendable apparatus, and a method of operating a drill head.

BACKGROUND ART

Devices and methods for installing ground anchoring systems, including drilling rock or tensioning rock bolts or other connectors, for example, are known from US 2007/0086862 A1, JPH 03125788 A, WO 2005/047649 A1, US 2007/0114070 A1, or US 2009/0304455 A1. However, further improvements of the devices and methods are sought. For example, operational safety, in particular related to operating temperatures, and less complexity, for example with respect to the provision of supply media, such as hydraulic oil, are important fields for improvements.

SUMMARY OF THE INVENTION

Therefore, it is an object of the present invention to provide an extendable apparatus, a drill head and a method of operating a drill head, which are improved over existing solutions with respect to at least one of the above mentioned goals.

This object is solved by an extendable apparatus, in particular for a drill head, comprising a base section and a drive section; an extension section and a functional section; the base section and the drive section being moveable with respect to the extension section and the functional section along a longitudinal axis; the drive section and the functional section being rotationally rigid coupled to each other; the base section and the extension section being rotationally rigid coupled to each other; the drive section and the functional section being rotationally moveable coupled to the extension section.

The extendable apparatus can be used for a drill head or together with a drill head, for example. Preferably, the extendable apparatus can also be referred to as an extendable cylinder, in particular, when referring to its inner, at least partly cylindrical sections interacting to realize the translational movement along a longitudinal axis. Herein, the term extendable cylinder also comprises extendable apparatuses as described herein, which may not have a cylindrical or rotationally symmetric outer surface or outer appearance, but rather comprise further units or elements, like a drive section as described further below.

The extendable apparatus comprises a base section and a drive section, which together are movable with respect to an extension section and a functional section along the longitudinal axis of the extendable apparatus. For ease of reference, the base section and the drive section can also be referred to together as a first translational unit and the extension section and the functional section can also be referred to as a second translational unit. In these terms, the first and the second translational unit can perform a translational movement relative to each other along a longitudinal axis of the extendable apparatus. In particular, the extension of the extendable apparatus as well as its retraction can be realized by the translational movement of the first translational unit comprising the base section and the drive section relative to the second translational unit comprising the extension section and the functional section.

Further, the drive section and the functional section are rotationally rigid coupled to each other. Also, the base section and the extension section are rotationally coupled to each other. This means that across the first and second translational units, rotational units between the drive section and the functional section on the one hand and the base section and the extension section on the other hand are formed. Thus, while the base section and the drive section are movable with respect to the extension section and the functional section along a longitudinal axis, a rotationally rigid coupling is realized between the base section and the extension section and between the drive section and the functional section.

Further still, the drive section and the functional section are coupled to the extension section in a rotationally movable way.

The extendable apparatus has the advantage that in general a lower operating temperature will be generated during operation of the extendable apparatus, in particular during drilling operation or rotational operation of the extendable apparatus, in particular, when applied in a drill head. The invention is based, inter alia, on the finding that a less complex construction and easier sealing arrangements, in particular rotational sealing arrangements, can be employed when the translational units are separated from the rotational mechanics and in particular the rotationally rigid couplings are chosen between sections such that a base section and the extension section can be decoupled in a rotational sense from the drive section and the functional section. By generating lower operating temperatures, operating safety can be increased alongside a longer lifetime, less wear on seal arrangements and other elements of the construction as well as broader ranges of applicability of the extendable apparatus, for example in areas with limited ranges of operating temperatures, all together. With a construction as described herein, operating temperatures of about 80-100° C. can be realized. One particular advantage of the extendable apparatus described herein is that the rotational seals do not need to withstand the high pressure of hydraulic fluid needed for operating the extendable apparatus, but only need to withstand atmospheric pressure. However, lower loads and stresses on the seals lead to lower operating temperatures. A further advantage of the lower load and stress on the seals, in particular of a construction which does not need high pressure rotational seals, is a higher lifetime of the components. For example, existing solutions may rely on a rotary union with seals resulting in high temperature during rotation. According to the solution described herein, supply media, such as hydraulic oil, can be supplied through a non-rotating section and thus a rotary union is not needed. The lower operating temperature leads to a lower risk of degradation, wear or rupture of lubrication or lubricating film and thus enhances reliability and service life of the extendable apparatus.

An embodiment of the extendable apparatus is particularly preferred, wherein the base section and the drive section are rotationally moveable relative to each other, and/or wherein the base section and the drive section are fixed relative to each other with respect to the longitudinal axis.

Additionally, or alternatively, an embodiment is preferred wherein the extension section and the functional section are rotationally moveable relative to each other, and/or wherein the extension section and the functional section are fixed relative to each other with respect to the longitudinal axis.

For example, in a preferred embodiment, the drive section may comprise a substantially shaft-form structure enclosing the functional section.

In a further preferred embodiment, the functional section may comprise a protrusion or spline coupling at its proximal end, wherein preferably the protrusion or spline coupling is rotationally rigid coupled with the drive section and longitudinally movable relative to the drive section.

It is further particularly preferred that the extension section and/or the base section are rotationally rigid coupled to a housing. In this embodiment, basically the extension section and/or the base section are fixed against rotation while the drive section and the functional section can be rotated. Further preferably, the base section and/or the drive section are translationally rigid coupled to a housing, such that the extension section and the functional section are translationally movable with respect to the base section and the drive section and the housing along the longitudinal axis. It is particularly preferred that the base section is rotationally rigid and translationally rigid coupled to the housing.

In a further preferred embodiment, the base section and/or the extension section comprise at least one connector for provision of supply media. Supply media can be any media needed for the operation of the extendable apparatus, in particular for driving the drive section and/or the functional section of the extendable apparatus, for example, via a drive unit, and/or for extending and/or retracting the extendable apparatus. Supply media can be, for example, hydraulic fluid, such as hydraulic oil, or electric energy. By providing at least one connector for provision of supply media at the base section and/or the extension section, preferably at the base section, which is rotationally rigid and translationally rigid coupled to a housing, the provision of supply media can be separated from rotating units or rotating segments. In particular, the transfer of pressurized hydraulic oil, for example, through a rotating unit, is no longer needed when a connector for provision of supply media, such as pressurized hydraulic oil, is located at base section and/or the extension section, in particular when the base section and/or the extension section are rotationally rigid coupled to the housing.

Further preferably, the functional section and/or the drive section are adapted for being rotationally driven by a drive unit about the longitudinal axis. Preferably, the drive section is coupled to the drive unit for being rotationally driven by the drive unit and to transmit a torque from the drive unit to the functional section. In this way, a torque can be applied from the drive unit via the drive section to the functional section and to a functional drill element, for example, connected to the functional section for a drilling operation.

According to a further preferred embodiment, the extendable cylinder comprises a fluid channel being part of the base section, and/or a chuck being part of the functional section; wherein the fluid channel and/or the chuck form a central cavity for supplying a fluid, in particular to the extension section and/or the functional section. The central cavity or central chamber through the extendable apparatus serves to supply a fluid, such as water or air, through the extendable apparatus and in particular to the extension section and/or the functional section, in particular to the distal end of the functional section.

A further preferred embodiment is characterized by a first sealing kit being arranged between the fluid channel and the extension section, and/or characterized by a second sealing kit being arranged between the chuck and the extension section.

Preferably, the first and/or second sealing kits are fluid seals sealing the central cavity against the extension section against the fluid carried or supplied within the central cavity, in particular the first and/or second sealing kit may be water seals. It is particularly preferred that one of the first and second sealing kits is designed for sealing against rotational movement and the other one is designed for translational movement. It is particularly preferred that the first sealing kit is designed for translational movement or sealing and the second sealing kit is designed for rotational movement and/or sealing. This separation has the advantage of increasing reliability and lifetime of the sealing kits.

Further, it is preferred that the first and second sealing kits are designed partly or fully identical and/or exchangeable. In this way, the complexity of the construction and the number of different parts can be reduced.

In a further preferred embodiment, the functional section is coupled to the extension section via a bearing, preferably a double row angular ball bearing. Preferably, the functional section is coupled to a distal end of the extension section via a bearing, preferably a double row angular ball bearing. The bearing preferably is an anti-friction bearing, preferably a ball and/or roller bearing. Preferably, the coupling between the functional section and the extension section is sealed and/or lubricated, in particular according to the expected lifetime of the extendable apparatus since during the lifetime of the extendable apparatus service and maintenance (with additional lubrication, for example) of the bearing may not be intended.

A further preferable embodiment of the extendable apparatus is characterized by an extension volume between the base section and the extension section, wherein the extendable apparatus is extendable by provision of hydraulic fluid to the extension volume.

A further preferable embodiment is characterized by a retraction volume between the base section and the extension section, wherein the extendable apparatus is retractable by provision of hydraulic fluid to the retraction volume.

Preferably, the base section and/or the extension section comprise a double-wall, and further preferably the extension volume can be formed therein such that the extendable apparatus can be extended by provision of hydraulic fluid thereto.

A further preferred embodiment is characterized by at least one torsionally rigid coupling between the functional section and the drive section for transmitting lateral forces in at least one direction different from a direction parallel to the longitudinal axis In addition to the transmission of lateral forces, additional side forces can be applied. Preferably, for example, side forces preferably can be supported by transmission elements like slide bearings between the functional section and the drive section or a spline coupling between the functional section and the drive section. Further preferably, the functional section comprises a substantially shaft-form structure enclosing the extension section.

According to a further aspect, the object is solved by a drill head, comprising an extendable apparatus as described above; a drive unit for rotationally driving the drive section and/or the functional section of the extendable apparatus about the longitudinal axis. As to the advantages, preferred embodiments and details of the drill head and its preferred embodiments, reference is made to the corresponding aspects and embodiments described above with respect to the extendable apparatus.

According to a further aspect, the object is solved by a method of operating a drill head as described above, comprising connecting a functional drill element to a functional section; rotating the functional section of the extendable apparatus by rotationally driving a drive section of the extendable apparatus; extending and/or retracting the extendable apparatus along the longitudinal axis.

As to the advantages, preferred embodiments and details of the method of operating a drill head and its preferred embodiments, reference is made to the corresponding aspects and embodiments described above, in particular with respect to the extendable apparatus and the drill head.

Preferred embodiments of the invention shall now be described with reference to the attached drawings, in which

DETAILED DESCRIPTION

Figure 1A:
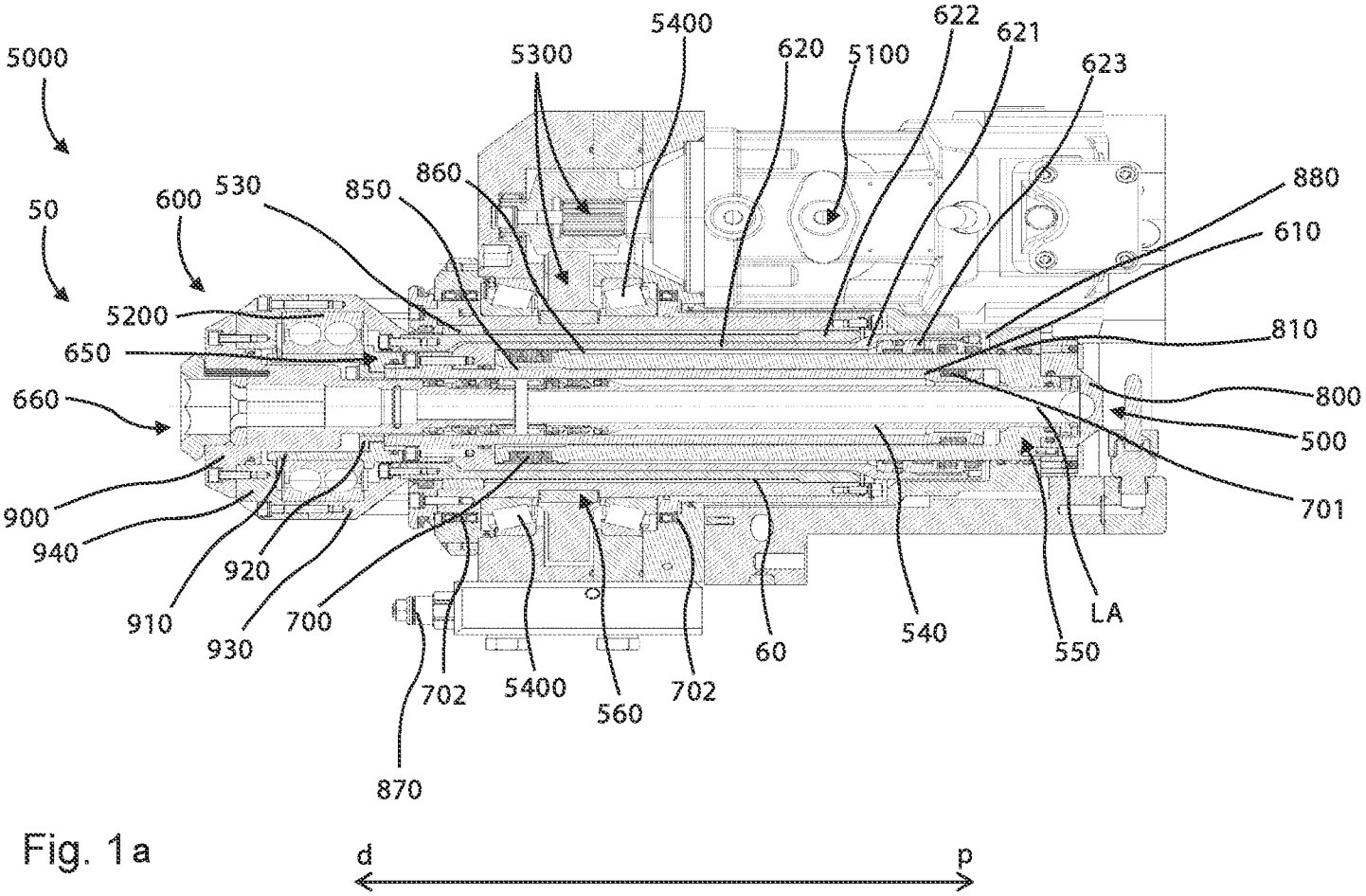
FIGS. 1*a* and 1*b*: show a longitudinal cross-sectional, lateral view of a drill head with an extendable apparatus in the retracted position and extended position.
Figure 1B:
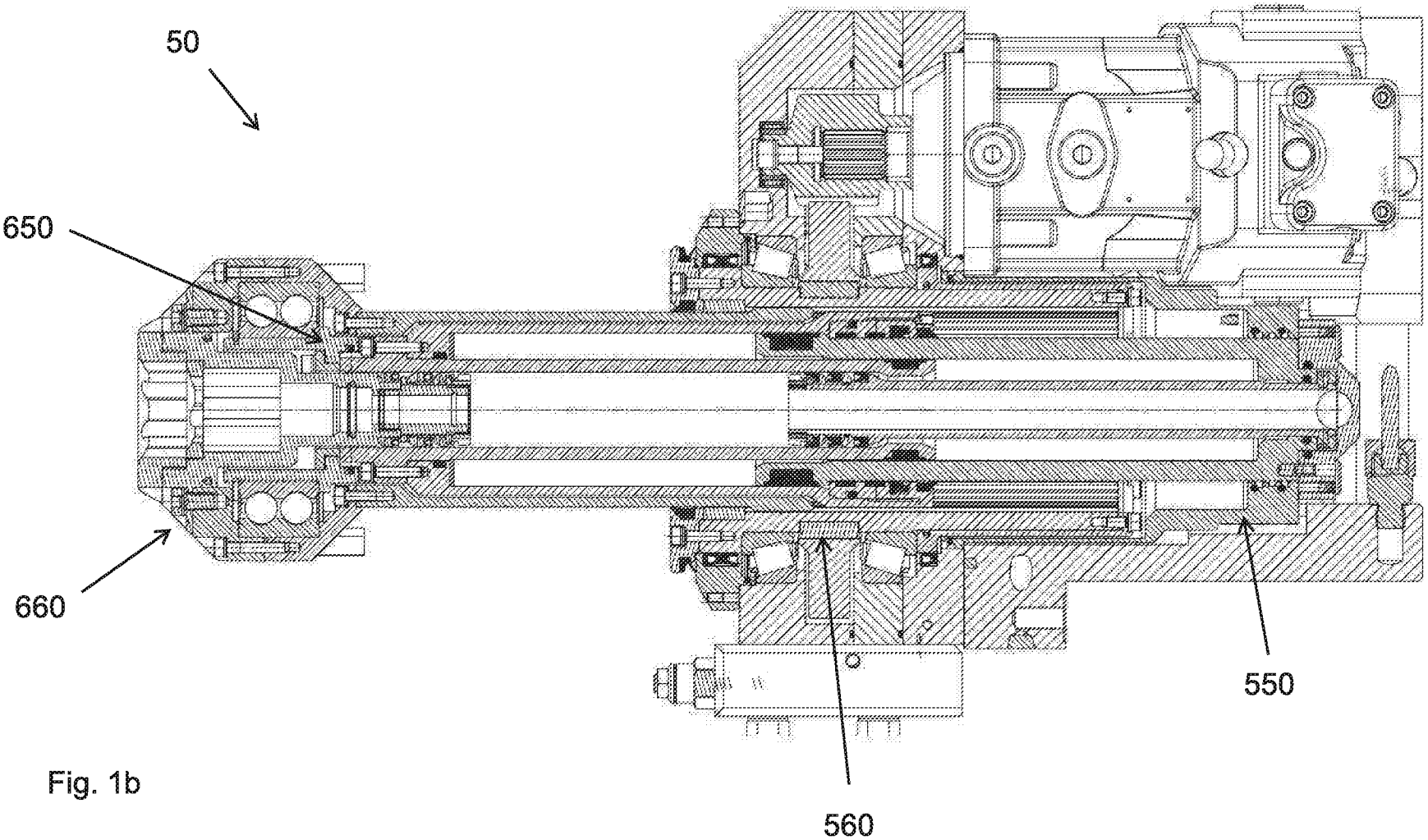
Figure 2A:
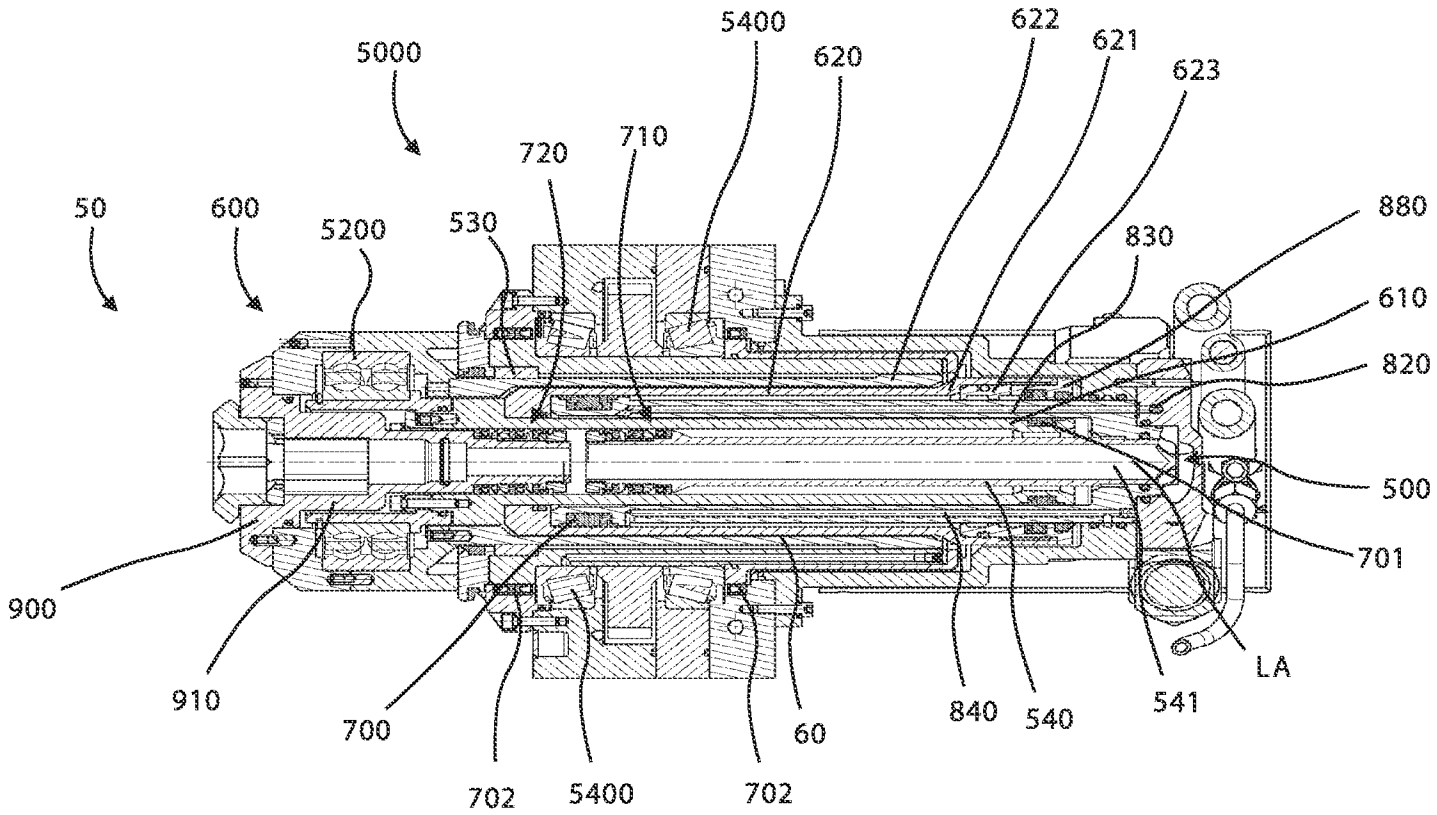
FIGS. 2*a* and 2*b*: show a longitudinal cross-sectional, plan view of the drill head of FIG. 1 with and without the functional drill element.
Figure 2B:
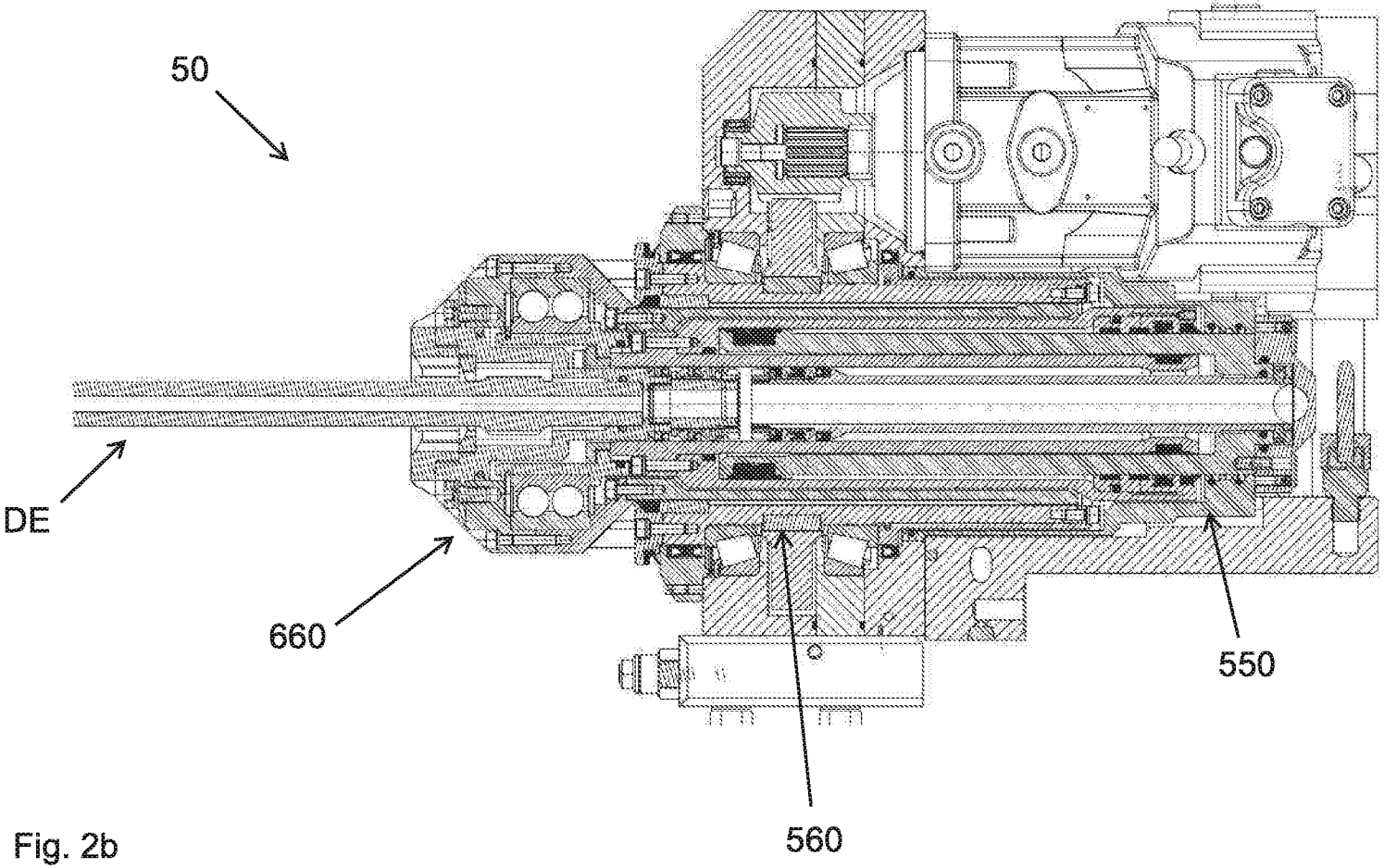
Figure 3:
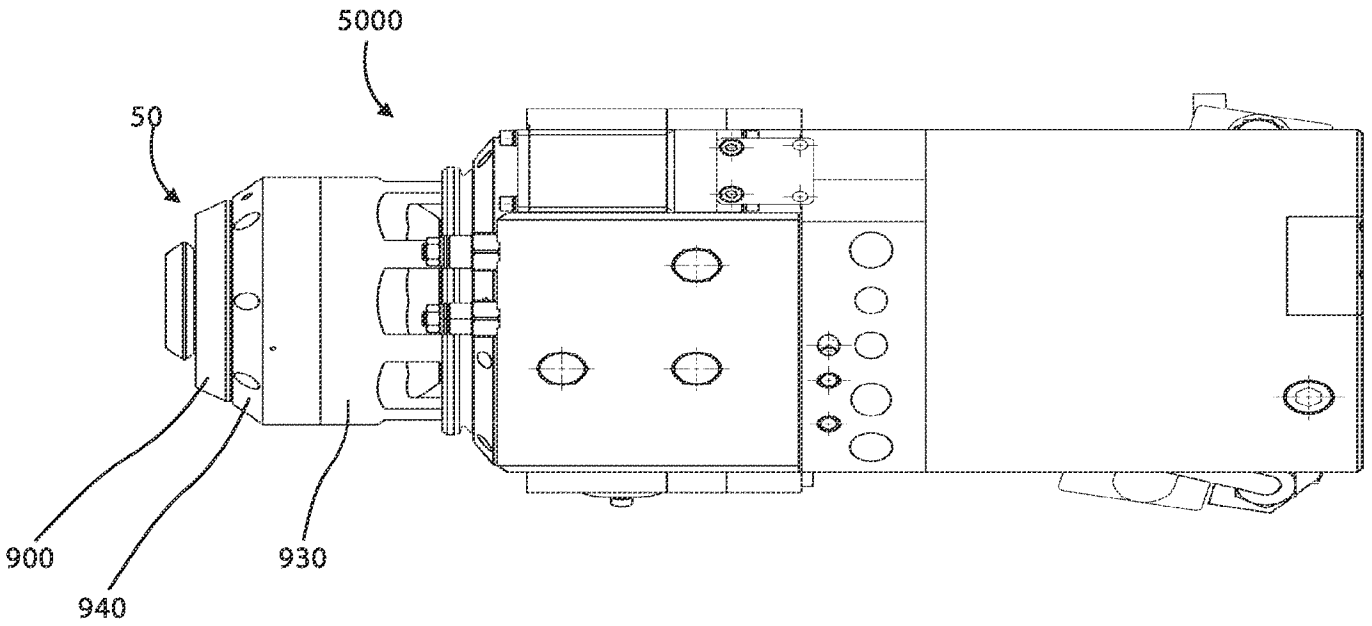
FIG. 3: shows a side view of the drill head from the opposite perspective as shown in FIG. 2.
Figure 4:
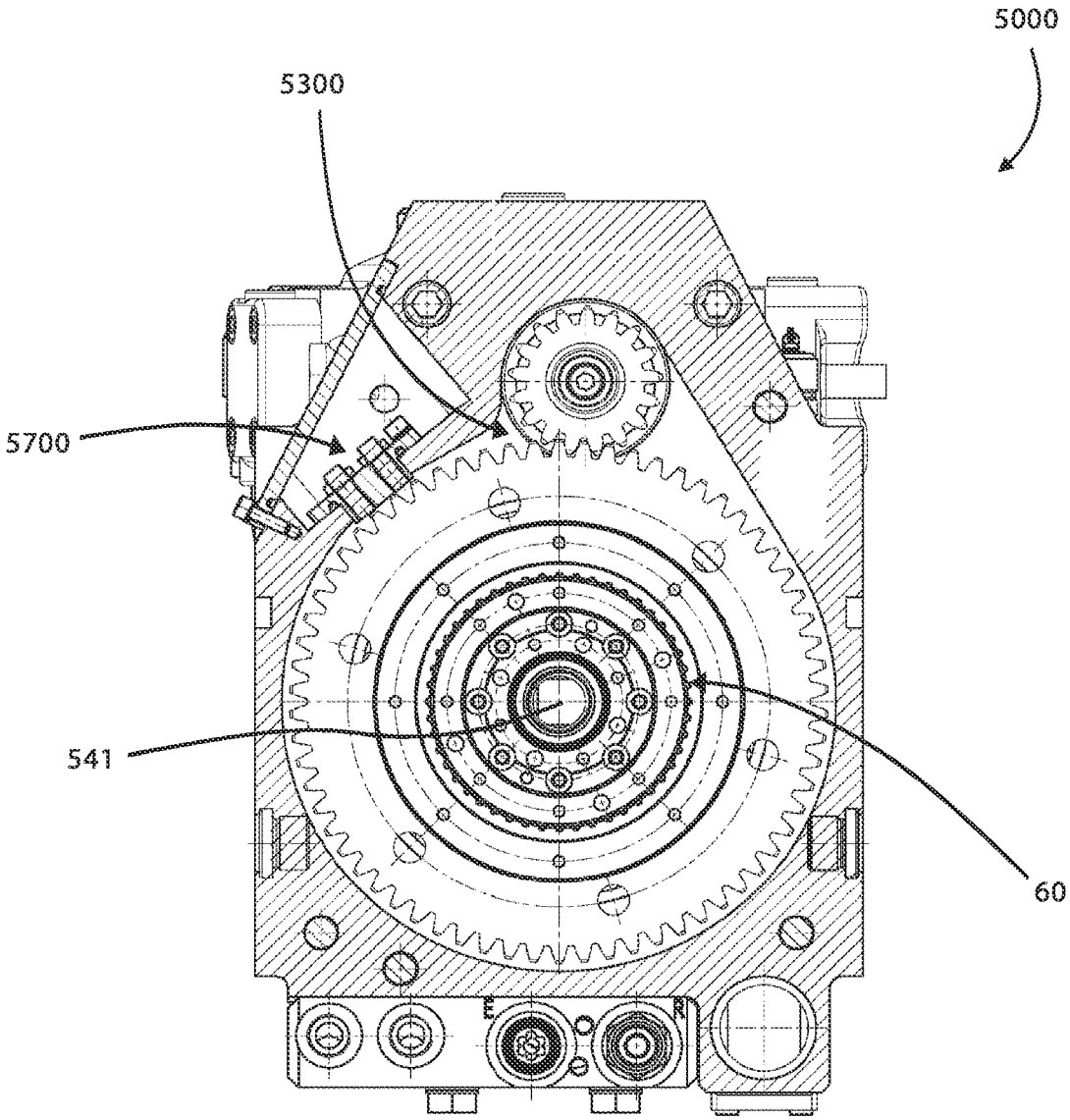
FIG. 4: shows a cross-sectional, plan view of a drill head cut in the area of the spur gear reduction.
Figure 5:
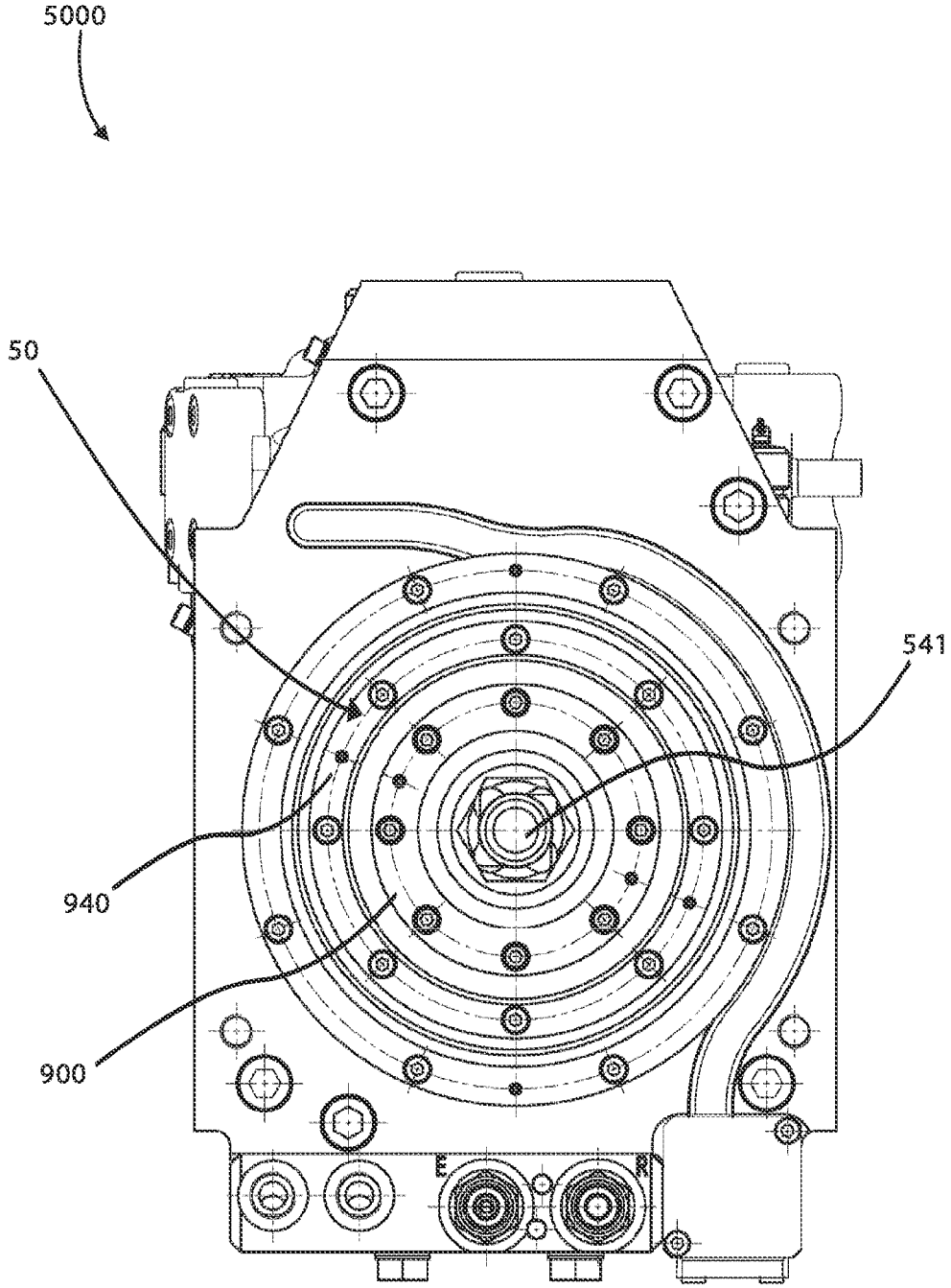
FIG. 5: shows a front view of the drill head.
Figure 6:
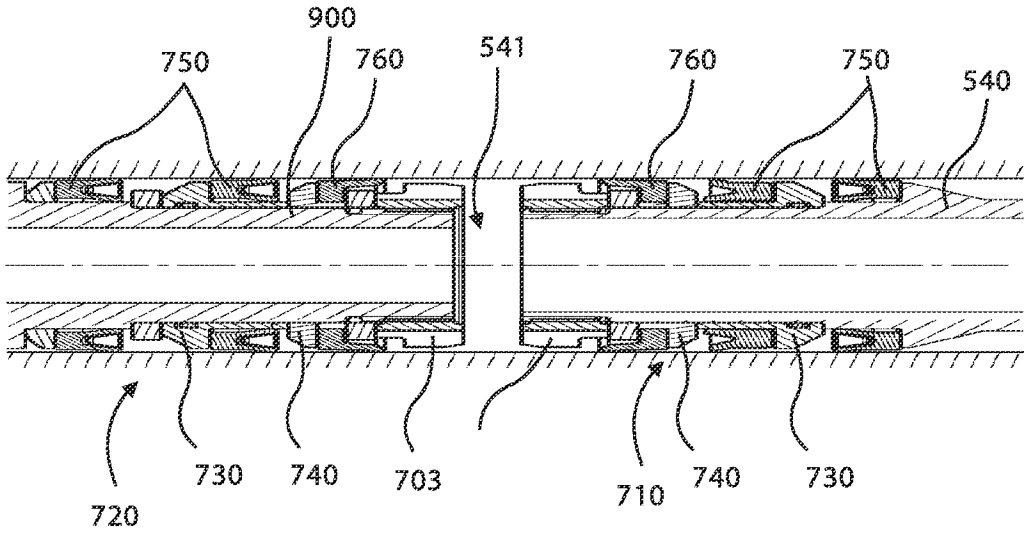
FIG. 6: shows an enlarged view of FIG. 1 in the area of the fluid channel.
Figure 7:
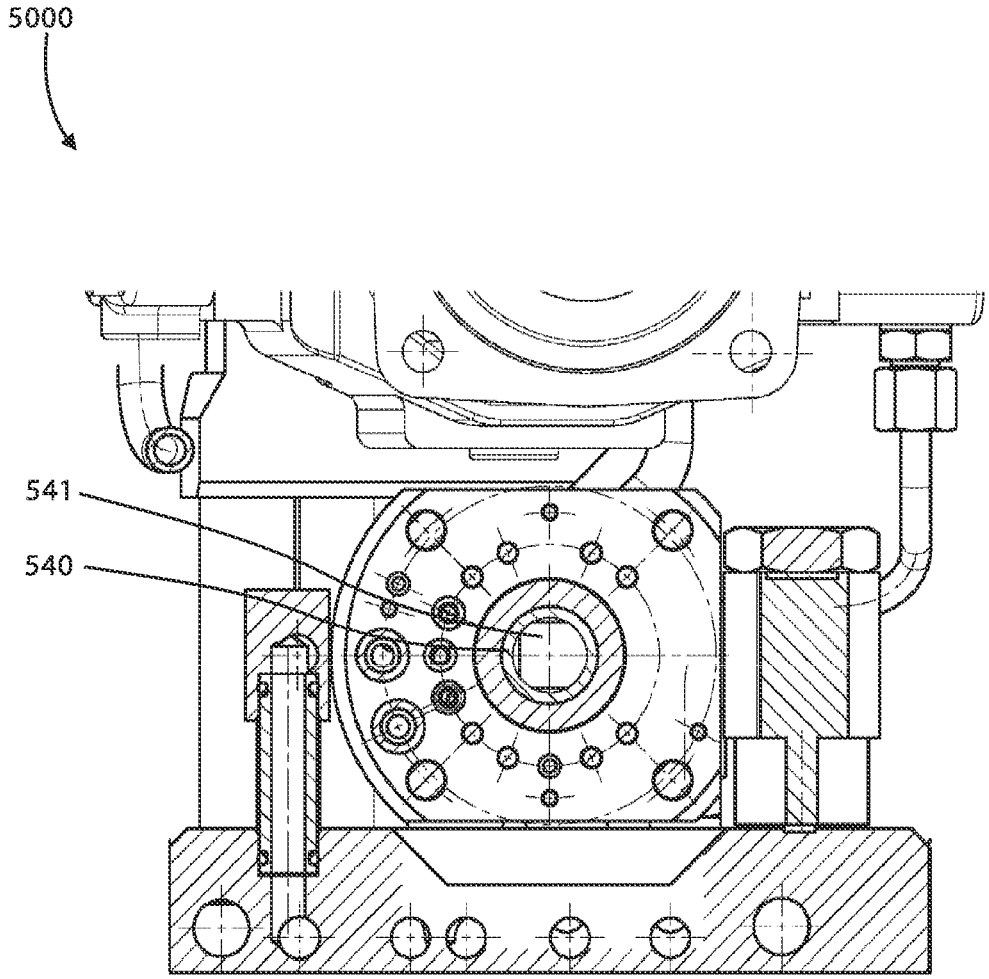
FIG. 7: shows a cross-sectional, view of the drill head cut in the area of the distal end.
Figure 8:
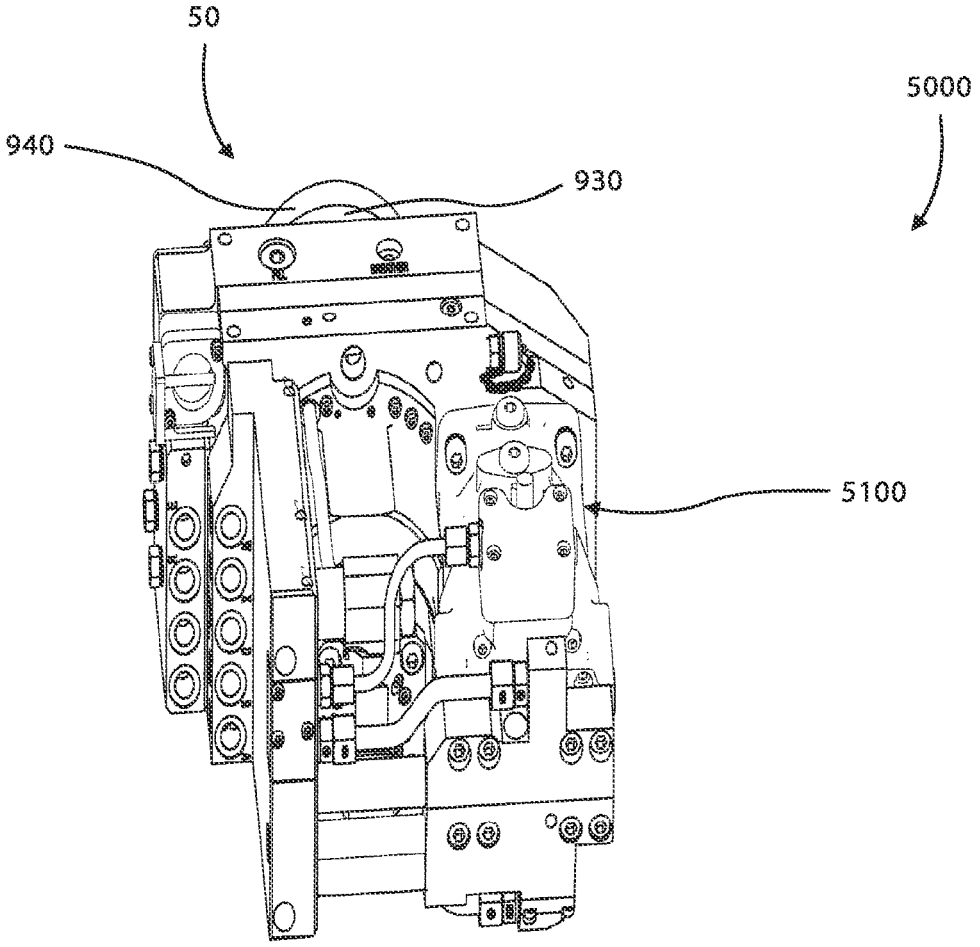
FIG. 8: shows a first three-dimensional depiction of the drill head.

In FIGS. 1-8 a preferred example of a drill head 5000 with an extendable apparatus 50 with a drive unit 5100 is shown. Although in the figures the extendable apparatus 50 is shown in the retracted position in FIG. 1*a*, the extendable apparatus 50 can be extended along its longitudinal axis LA by a translational movement of the second translational unit 600 comprising the extension unit 650 and the functional section 660 relative to the first translational unit 500 comprising the base section 550 and the drive section 560 as shown in FIG. 1*b*. The drive section 560 and the functional section 660 are rotationally rigid coupled to each other, as well as the base section 550 and the extension section 650 are rotationally rigid coupled to each other. The drive section 560 and the functional section 660 are rotationally movable coupled to the extension section 650. Functional drill element DE is connectable to functional section 660 as shown in FIG. 2*b*.

Further, the base section and the drive section are rotationally movable relative to each other and fixed relative to each other with respect to the longitudinal axis LA. Similarly, the extension section 650 and the functional section 660 are rotationally movable relative to each other and fixed relative to each other with respect to the longitudinal axis LA. Both, the extension section 650 and the base section 550 are rotationally rigid coupled to a housing. The functional section 660 and the drive section 560 are adapted for being rotationally driven by the drive unit 5100 about the longitudinal axis LA. Drive unit 5100 is adapted to drive the drive section 560 via the spur gear reduction stage 5300, which transfers the torque to the drive section. The extendable apparatus 50 is supported by taper roller bearings 5400 arranged back to back. The two rings of taper roller bearings 5400 are adapted to receive the loads and forces coming from operation of the drill head 5000. Next to the taper roller bearings 5400, V-rings 702 are located. On the distal side, these are arranged as double-V-rings. These rotational seals or V-rings 702 need to have a compact desing based on the limited space available. Speed sensors 5700 are adapted to control the speed of the rotation.

The drive section 560 has a substantially shaft-formed structure enclosing the functional section 660. The functional section 660 has a substantially shaft-formed structure enclosing the extension section 650. Further, the functional section 660 comprises a protrusion or spline coupling 622 at its proximal end, wherein the protrusion or spline coupling 622 is rotationally rigid coupled with the drive section 560 and longitudinally or translationally moveable relative to the drive section 560. Further, at least one torsionally rigid coupling 60 is located between the functional section 660 and the drive section 560 for transmitting lateral forces in at least one direction, different from a direction parallel to the longitudinal axis LA. Additional side forces can be supported by the spline coupling 622 and/or by the transmission element 530 in the form of the slide bearing between the functional section 660 and the drive section 560. The base section 550 is sealed against the extension section 650 via first and second main sealing kits 700, 701. The extension section 650 comprises a double-wall with an inner wall 610 and an outer wall 620. At the proximal end 621 of the outer wall, a sealing sleeve 623 is located.

Connectors for the provision of hydraulic fluid in the form of hydraulic fluid supply 800 are realized at the base section 550, namely in the form of a radial hydraulic fluid supply 810 and a longitudinal hydraulic fluid supply 820, which feed first and second hydraulic fluid channels 830, 840 to supply pressurized hydraulic fluid to the extension volume 850 between the base section 550 and the extension section 650 and to the retraction volume 860 between the base section 550 and the extension section 650. The extendable apparatus 50 is extendable by provision of hydraulic fluid to the extension volume 850 and it is retractable by provision of hydraulic fluid to the retraction volume 860. Space 880 is connected to a breather in order to allow for the extendable apparatus to be extended and retracted. The complete functions of the extendable apparatus 50 are hydraulically secured against overloads or excess pressure by a pressure valve 870.

A fluid channel 540 is part of the base section 550 and a chuck 900 is part of the functional section 660. Together, the fluid channel 540 and the chuck 900 form a central cavity 541 or central chamber for supplying a fluid, in particular water or air, to the extension section 650 and in particular to the functional section 660, particularly the distal end of the function section 660. A first sealing kit 710 is arranged between the fluid channel 540 and the extension section 650 and is adapted for translational movement or sealing. A second sealing kit 720 is arranged between the chuck 900 and the extension section 650 and is adapted for rotational movement or sealing. As can be seen in particular from FIG. 6, both sealing kits 710, 720 are realized identical or exchangeable with first water seals 750, second water seals 760 and first and second water sealing sleeves 730, 740. At the proximal end of the chuck 900 as well as at the distal end of the fluid channel 540, nuts 703 are located.

The functional section 660 is coupled to the extension section 650 via a double row angular ball bearing 5200, which is positioned between an inner bearing sleeve 910, a holding sleeve 920, a first bearing housing 930 and a second bearing housing 940.

The invention claimed is:

1. An extendable apparatus for a drill head, comprising:
a base section;
a drive section;
an extension section; and
a functional section, the base section and the drive section being moveable with respect to the extension section and the functional section along a longitudinal axis, the drive section and the functional section being rotationally rigid coupled to each other, the base section and the extension section being rotationally rigid coupled to each other, and the drive section and the functional section being rotationally moveably coupled to the extension section, wherein the functional section is arranged to receive a functional drill element for performing a drilling operation.

2. The extendable apparatus according to claim 1, wherein the base section and the drive section are rotationally moveable relative to each other.

3. The extendable apparatus according to claim 1, wherein the extension section and the functional section are rotationally moveable relative to each other.

4. The extendable apparatus according to claim 1, wherein at least one of the extension section and the base section are rotationally rigidly coupled to a housing.

5. The extendable apparatus according to claim 1, wherein at least one of the base section and the extension section include at least one connector for the provision of a supply media.

6. The extendable apparatus according to claim 1, wherein at least one of the functional section and the drive section are rotationally driven by a drive unit about the longitudinal axis.

7. The extendable apparatus according to claim 1, wherein the functional section is coupled to the extension section via a bearing.

8. The extendable apparatus according to claim 7, wherein the bearing is a double row angular ball bearing.

9. The extendable apparatus according to claim 1, wherein an extension volume is disposed between the base section and the extension section, wherein the extendable apparatus is extendable by provision of hydraulic fluid to the extension volume.

10. The extendable apparatus according to claim 1, wherein a retraction volume is disposed between the base section and the extension section, wherein the extendable apparatus is retractable by provision of hydraulic fluid to the retraction volume.

11. The extendable apparatus according to claim 1, wherein at least one torsionally rigid coupling is disposed between the functional section and the drive section for transmitting lateral forces in at least one direction different from a direction parallel to the longitudinal axis.

12. The extendable apparatus according to claim 1, wherein the base section and the drive section are fixed relative to each other with respect to the longitudinal axis.

13. The extendable apparatus according to claim 1, wherein the extension section and the functional section are fixed relative to each other with respect to the longitudinal axis.

14. The extendable apparatus according to claim 1, further comprising a chuck formed as part of the functional section, wherein the chuck forms a central cavity for supplying a fluid to the extension section and/or the functional section.

15. The extendable apparatus according to claim 14, wherein a second sealing kit is arranged between the chuck and the extension section.

16. An extendable apparatus for a drill head comprising:
a base section;
a drive section;
an extension section;
a functional section, the base section and the drive section being moveable with respect to the extension section and the functional section along a longitudinal axis, the drive section and the functional section being rotationally rigid coupled to each other, the base section and the extension section being rotationally rigid coupled to each other, and the drive section and the functional section being rotationally moveably coupled to the extension section, wherein the functional section is arranged to connect a functional drill element for performing a drilling operation; and
a fluid channel formed as part of the base section, wherein the fluid channel forms a central cavity for supplying a fluid to the extension section and/or the functional section.

17. The extendable apparatus according to claim 16, wherein a first sealing kit is arranged between the fluid channel and the extension section.

18. A drill head, comprising:
an extendable apparatus according to claim 1; and
a drive unit arranged for rotationally driving at least one of the drive section and the functional section of the extendable apparatus about the longitudinal axis.

19. A method of operating a drill head, comprising the steps of:
providing a drill head according to claim 18;
connecting a functional drill element to the functional section;
rotating the functional section of the extendable apparatus by rotationally driving the drive section of the extendable apparatus; and
extending and/or retracting the extendable apparatus along the longitudinal axis.

* * * * *